US005368208A

United States Patent [19]

Nishimura et al.

[11] Patent Number: 5,368,208

[45] Date of Patent: Nov. 29, 1994

[54] APPARATUS FOR SHIELDING AIR FROM MOLTEN METAL FLOW FROM LADDLE TO TUNDISH IN CONTINUOUS CASTING FACILITIES

[75] Inventors: Kouhachi Nishimura; Takanobu Kishino, both of Kobe, Japan

[73] Assignee: Kabushiki Kaisha Kobe Seiko Sho, Kobe, Japan

[21] Appl. No.: 613,798

[22] Filed: May 24, 1984

[51] Int. Cl.[5] ..... B22D 37/00

[52] U.S. Cl. ..... 222/603; 222/606; 164/437; 266/236

[58] Field of Search ..... 222/606, 607, 591, 603, 222/504, 526; 266/236; 164/437, 438

[56] References Cited

U.S. PATENT DOCUMENTS

| | | | |
|---|---|---|---|
| 3,554,520 | 1/1971 | Grosko | 222/607 X |
| 3,673,039 | 6/1972 | Todd | 222/603 X |
| 4,270,595 | 6/1981 | Coward | 266/236 X |
| 4,290,589 | 9/1981 | Lührsen et al. | 222/606 X |
| 4,325,502 | 4/1982 | Weaver | 222/504 |

*Primary Examiner*—Joseph J. Rolla
*Assistant Examiner*—David H. Bollinger
*Attorney, Agent, or Firm*—Oblon, Spivak, McClelland, Maier & Neustadt

[57] ABSTRACT

A sealing apparatus for shielding air from a path of molten steel in a laddle to a tundish in continuous metal casting facilities to prevent oxidation of the molten metal, the apparatus including a seal box lift mechanism mounted on a tundish body through a bracket and including a drive member and a lift rod member to be vertically moved up and down by the drive member; a seal box including an outer cylinder fixedly mounted on a tundish cover and extending into the tundish, and an inner cylinder telescopically fitted in the outer cylinder and connected to the lift rod member through a lever; a first seal member fixed at the upper end of the inner cylinder and pressed against a nozzle mounting surface of the laddle when the inner cylinder is lifted up by the lift rod member; a second seal member fixed on the outer cylinder to seal gap space between the outer and inner cylinders; and an inert gas inlet provided in the wall of the inner cylinder.

5 Claims, 3 Drawing Sheets

APPARATUS FOR SHIELDING AIR FROM MOLTEN METAL FLOW FROM LADDLE TO TUNDISH IN CONTINUOUS CASTING FACILITIES

BACKGROUND OF THE INVENTION

1. Field of the Invention

This invention relates to an apparatus for shielding air from a path of molten metal in a laddle to a tundish in continuous casting facilities to prevent oxidation of the molten metal with a recognition of the fact that, in continuous casting facilities, molten metal in a laddle is poured, through a nozzle provided in the bottom wall of the laddle, into a tundish which is located beneath the nozzle and then into a casting mold and, at such time, it is necessary to prevent oxidation of the molten metal which would occur by contact with air between the laddle and tundish.

2. Description of the Prior Art

In order to prevent oxidation of molten metal, it has been the conventional practice to set a seal box on a tundish cover where utilizing a manner to circumvent the nozzle of a laddle in a laddle support structure without a laddle lift mechanism, injecting an inert gas into a gap space between the laddle nozzle and seal box to prevent contact with air of the effluent molten metal from the laddle. However, the seal provided by an apparatus of such an arrangement is incomplete, has only a small sealing effect, and requires a large quantity of inert gas to maintain an inert atmosphere in the gap space between the laddle and seal box, coupled with problems connected with safety of operations on the casting floor.

On the other hand a laddle support structure with a laddle lift mechanism is free of the above-mentioned problem of contact with air of the effluent molten metal, but instead has drawbacks such as complication in construction and an increase in production cost. Owing to wide use of laddle support structures without a laddle lift mechanism, there has been a strong demand for an apparatus capable of preventing oxidation of molten metal without the accompanying aforementioned drawbacks.

SUMMARY OF THE INVENTION

It is an object of the present invention to provide an apparatus which can satisfy the above-mentioned demand, It is a more particular object of the present invention to provide an apparatus for preventing oxidation of molten metal by shielding air from a path of molten metal in a laddle to a tundish in continuous casting facilities without a laddle lift mechanism on a laddle support structure, which is simple in construction and has a reliable sealing effect.

It is another object of the present invention to provide an apparatus of the sort mentioned above, which is removable to appropriate better working conditions on a casting floor.

According to the present invention, there is provided an apparatus for shielding air from a path of molten metal in a laddle to a tundish in continuous casting facilities to prevent oxidation of the molten metal, comprising a seal box lift mechanism mounted on a tundish body through a bracket and having a drive means and a lift rod member vertically movable by the drive means; a seal box having an outer cylinder fixedly mounted on a tundish cover and extending into the tundish, and an inner cylinder telescopically fitted in the outer cylinder and connected to the lift rod of the seal box lift mechanism through a lever; a first seal member fixedly provided at the upper end of the inner cylinder and pressed against a nozzle mounting surface of the laddle when the inner cylinder is lifted; a second seal member fixed on the outer cylinder to seal a gap space between the outer and inner cylinders; and an inert gas inlet port provided in the inner cylinder.

The above and other objects, features and advantages of the present invention will become apparent from the following description and appended claims, taken in conjunction with the accompanying drawings which show by way of example a preferred embodiment of the invention.

DETAILED DESCRIPTION OF THE PREFERRED EMBODIMENT

Figure 1:
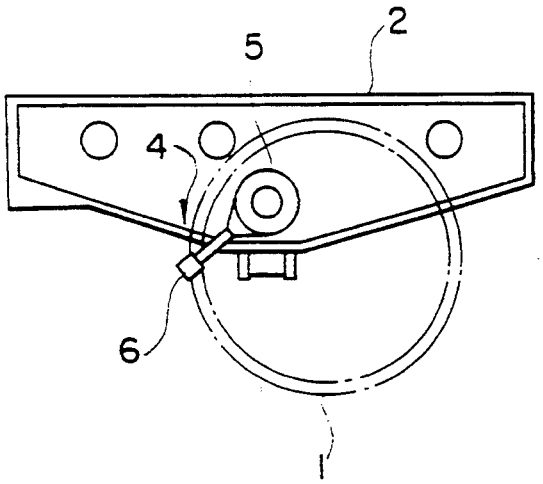
FIG. 1 is a schematic plan view of laddle and a tundish.
Figure 2:
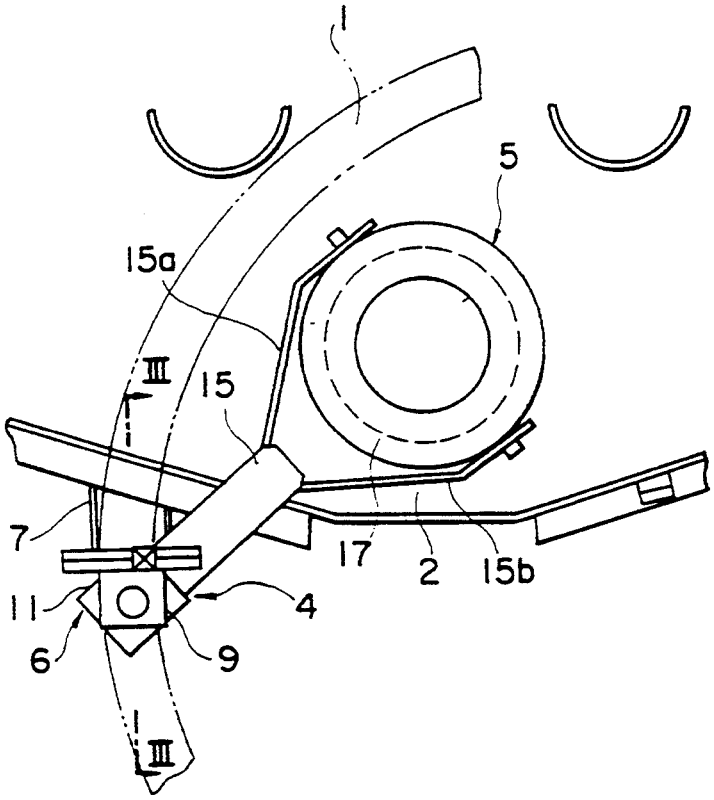
FIG. 2 is an enlarged fragmentary view of the laddle and tundish of FIG. 1.

Referring to the drawings, denoted at 1 is a laddle, at 2 a tundish, at 3 a tundish cover, and at 4 a sealing apparatus which is mounted on the tundish 2 to prevent oxidation of molten metal and which consists of a seal box 5 and a seal box lift mechanism 6.

The seal box lift mechanism 6 is provided with a motor-driven cylinder having a lower case 10 thereof mounted through a trunnion on a lower portion of a support frame 8 attached to a bracket 7 which is projectingly provided on a side wall 2*a* of the tundish 2. The motor driven cylinder 9 transmits the driving force of a brake motor 11 to a gear and a ball screw mechanism (not shown). A ball nut which is in meshing engagement with the ball screw is connected to a pipe rod 12 to shift the latter up and down by the motor 11. The upper end of the pipe rod 12 is connected to a rod 14 through a bracket 13, and the upper end of the rod 14 is connected to a lever 15. The rod 14 is vertically movably supported on the frame 8 and has a pain of upper and lower limit switches 16A and 16B mounted thereon for detection of its stroke, namely, for controlling the upper and lower limit positions of the rod 14. The lever 15 is extended over the tundish cover 3 and has bifurcated portions 15*a* and 15*b* at its fore end to thereby support the opposite sides of an inner cylinder 17 of the seal box 5.

The seal box 5 is constituted by the above-mentioned inner cylinder 17 and an outer cylinder 18, which outer cylinder 18 has a base 19 mounted around the outer periphery of its upper end. The base 19 is fixedly stopped in position by engagement with an upper marginal edge portion of a mounting hole 3*a* bored through the tundish cower 3, supporting thereon the outer cylinder 18 which is extended inward of the tundish 2. The outer cylinder 18 is provided with an asbestos packing 20 at the upper end thereof to provide a seal between the outer cylinder 18 and the inner cylinder 17 which is telescopically fitted in the outer cylinder 18.

Figure 3:
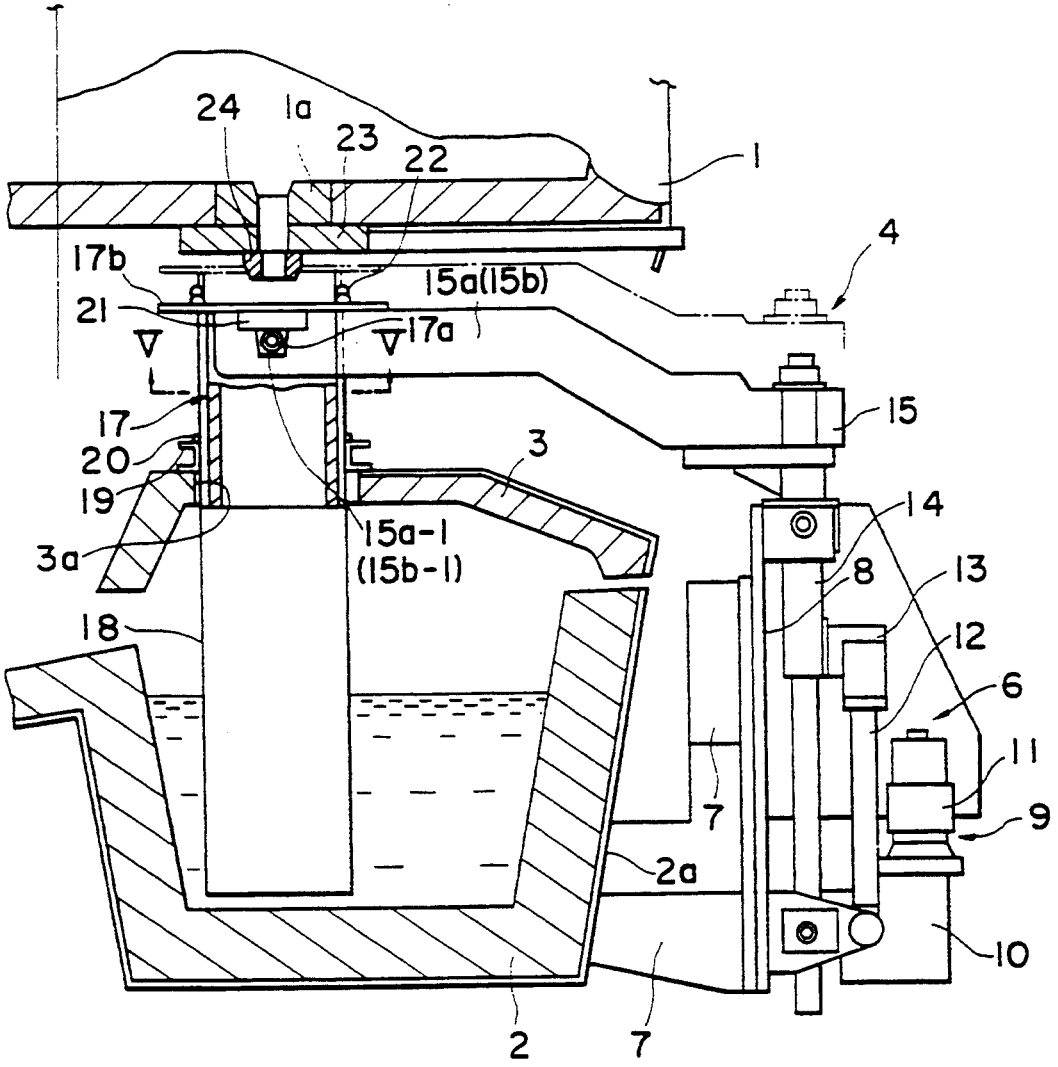
FIG. 3 is a schematic sectional view taken along line III—III of FIG. 2.
Figure 4:
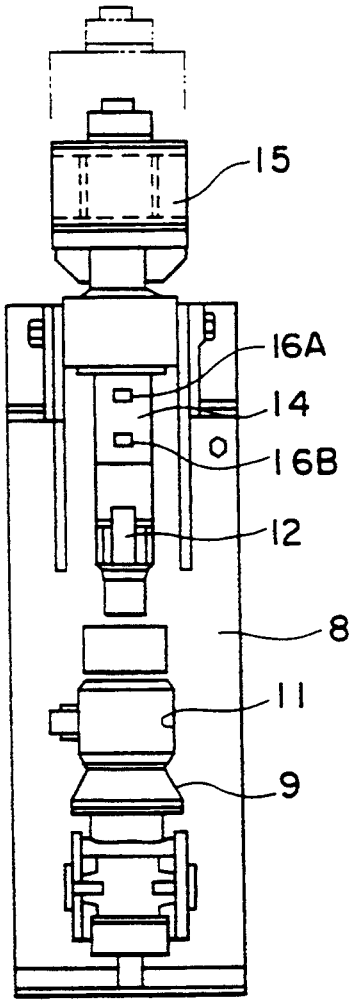
FIG. 4 is a schematic side view taken from the right side of FIG. 3.
Figure 5:
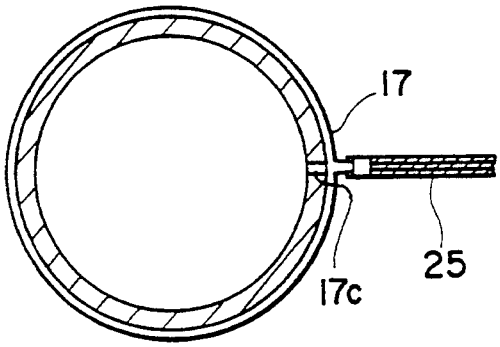
FIG. 5 is a sectional view taken on line V—V of FIG. 3.

The inner cylinder 17 is securely supported on the lever 15 by recesses 15*a*-1 and 15*b*-1 which are formed on the bifurcated portions 15*a* and 15*b* of the lever 15 and held in fitting engagement with support shafts 17a laterally projecting from the outer wall of the inner cylinder 17 in its upper end portion, by means of press plates 21 which are located on the outer sides of the recesses 15*a*-1 and 15*b*-1. Provided at the upper end of the inner cylinder 17 is a flange 17*b* which is extended horizontally on the inner and outer sides of the inner cylinder 17 and has a seal material, asbestos packing 22, fixed on the upper end face thereof to be pressed against a side valve 23 on the lover side of a nozzle 1*a* of the laddle 1 when the inner cylinder 17 is lifted up as shown in phantom lines in FIG. 3, securely sealing the outer periphery of a chute nozzle 24 which is fixed on the lover side of the slide valve 23. Further, the inner cylinder 17 is provided with an inert gas inlet port 17*c*, and an inert gas feed hose 25 is connected to the inert gas inlet port 17*c*.

With the sealer of the above-described construction, the inert gas hose 25 is connected to the inner cylinder 17 of the seal box 5 before lifting up the inner cylinder 17 by the motor driven cylinder 9 to press the asbestos packing 22 on the upper end face against the slide valve 23 on the part of the laddle 1. At this time, the asbestos packing 20 seals the gap space between the inner cylinder 17 which is elevated by the cylinder 9 and the outer cylinder 18 which is fixed to the tundish cover 3, thus providing a perfect seal between the laddle 1 and tundish 2. As an inert gas is introduced into the inner cylinder 17 of the seal box 5 through the hose 25, the interior of the seal box 5 between the laddle 1 and tundish 2 is completely shielded from the atmosphere, precluding any chance of contact with air of the molten metal which is poured into the tundish 2 through the chute nozzle 24 of the laddle 1 and the inner and outer cylinders 17 and 18.

On the other hand, in order to detach the seal box 5 from the laddle 1, it suffices to lower the inner cylinder 17 by the motor cylinder 9. As the inner cylinder 17 is lifted up and down by the motor-driven cylinder 9, it is subjected to a thrust pushing up the inner cylinder 17 at the time of the ascending operation and to a force acting to lower the inner cylinder 17 into the outer cylinder 18 at the time of the descending operation.

As is clear from the foregoing description, the sealing apparatus of the present invention can be suitably mounted on a tundish of continuous casting facilities without a laddle lift mechanism on a laddle support structure, to thereby completely seal a path of molten metal from the laddle to the tundish. Therefore, such has a high sealing effect for shielding air from a path of molten metal in the laddle to the tundish, and can prevent oxidation of molten metal in a reliable manner without requiring a large quantity of inert gas. In addition, the sealing mechanism of the invention can be operated automatically in an extremely simple fashion, controlling the operation of the motor-driven cylinder through detectors including limit switches mentioned hereinabove.

Although the invention has been described and shown by way of a preferred embodiment, it is to be understood that it is possible to make various modifications or alterations thereto within the scope of the invention as defined in the following claims.

What is claimed is:

1. A sealing apparatus for shielding air from a path of molten metal in a laddle, having a nozzle mounting surface, to a tundish having a tundish body and a cover in a continuous casting facility to prevent oxidation of the molten metal, said apparatus comprising:

a seal box lift mechanism on said tundish body and which further comprises drive means and a lift rod member to be vertically moved by said drive means;

a seal box having an outer cylinder, said outer cylinder including a base fixedly mounted on said tundish cover, and extending into said tundish, and an inner cylinder telescopically fitted in said outer cylinder;

lever means for connecting said inner cylinder to said lift rod member and for vertical movement of said inner cylinder with respect to said outer cylinder forward and away from said laddle;

first seal means fixed at an upper end of said inner cylinder and pressed against said nozzle mounting surface of said laddle when said inner cylinder is lifted by said lift rod member;

inert gas inlet port means provided in said inner cylinder for communication of inert gas into said inner cylinder; and second seal means fixed on said outer cylinder for sealing a gap space between said outer and inner cylinders during feeding of inert gas to said inner cylinder.

2. An apparatus as set forth in claim 1, wherein said drive means of said seal box lift mechanism further comprises a motor-driven cylinder and further comprising transmission means for connecting said drive means to said lift rod member wherein said lever is vertically movably supported at an upper end of said lift rod member and provided with bifurcated portions at a fore end thereof to thereby securely hold opposite sides of said inner cylinder and said seal box.

3. An apparatus as set forth in claim 2, further comprising laterally extending support shafts provided on the outer periphery of said inner cylinder and upon which said bifurcated portions of said lever are secured.

4. An apparatus as set forth in claim 1, wherein said inner cylinder of said seal box further comprises a flanged wall at an upper end thereof and wherein said first seal member is fixed on an upper end face of said flanged wall.

5. An apparatus as set forth in claim 4, wherein said first and second seal members each further comprise asbestos packing seal members.

* * * * *